US009591900B2

(12) United States Patent
Huynh

(10) Patent No.: US 9,591,900 B2
(45) Date of Patent: Mar. 14, 2017

(54) CLOSURE FOR ARTICLE, IN PARTICULAR FOR JEWELRY

(71) Applicant: Grand Rainbow International Limited, Causeway Bay (CN)

(72) Inventor: Khanh Tan Huynh, Ashwood (AU)

(73) Assignee: Grand Rainbow International Limited, Kowloon (HK)

( * ) Notice: Subject to any disclaimer, the term of this patent is extended or adjusted under 35 U.S.C. 154(b) by 3 days.

(21) Appl. No.: 14/513,272

(22) Filed: Oct. 14, 2014

(65) Prior Publication Data

US 2015/0027167 A1 Jan. 29, 2015

Related U.S. Application Data

(63) Continuation of application No. 13/454,231, filed on Apr. 24, 2012, now Pat. No. 8,881,550.

(51) Int. Cl.
*A44C 7/00* (2006.01)
*A44C 27/00* (2006.01)

(52) U.S. Cl.
CPC ..... *A44C 7/00* (2013.01); *A44C 7/003* (2013.01); *A44C 7/007* (2013.01); *A44C 27/008* (2013.01); *Y10T 29/49595* (2015.01)

(58) Field of Classification Search
CPC ..... A44C 7/006; A44C 7/00; A44C 7/003; A44C 7/007; A44C 5/12; A44C 9/0046; A44C 27/008; A44B 6/00; Y10T 16/5383; Y10T 29/49595
USPC .... 63/12, 14.5, 13, 8; 267/158; 16/227, 277, 16/297, DIG. 36
See application file for complete search history.

(56) References Cited

U.S. PATENT DOCUMENTS

| | | | |
|---|---|---|---|
| 240,857 | A | 5/1881 | Smith |
| 247,876 | A | 10/1881 | Becker |
| 271,121 | A | 1/1883 | Riley et al. |
| 1,967,965 | A | 7/1934 | Morehouse et al. |
| 2,733,491 | A | 2/1956 | Saccoccio |

(Continued)

FOREIGN PATENT DOCUMENTS

| | | |
|---|---|---|
| CN | 1216447 | 5/1999 |
| CN | 1392778 | 1/2003 |

(Continued)

OTHER PUBLICATIONS

Applicant-Initiated Interview Summary Dated Nov. 7, 2013 From the US Patent and Trademark Office Re. U.S. Appl. No. 13/454,231.

(Continued)

*Primary Examiner* — Jack W Lavinder

(57) ABSTRACT

A jewelry item has a closure that uses shape memory to provide two stable positions. For example, an earring has a setting and a pin, and the closure closes the pin over the ear. The closure consists of a leaf spring extending outwardly in a first loop part from a first location on the setting and looping back in a second loop part to a second location adjacent the first location on the setting. The loop parts each have shape memory and are set with different remembered shapes. The two different remembered shapes work against each other to flip the closure between two stable positions, a first position in which the closure connects to the pin to close the earring and a second position in which the closure is spaced away from the pin to open the earring. The design is particularly suitable for a huggie style earring.

11 Claims, 4 Drawing Sheets

(56) References Cited

U.S. PATENT DOCUMENTS

| | | | |
|---|---|---|---|
| 4,694,664 | A | 9/1987 | Elsener |
| 4,815,180 | A | 3/1989 | Elsener |
| 5,025,643 | A | 6/1991 | Chan et al. |
| 5,079,933 | A | 1/1992 | Alviti |
| 5,468,220 | A | 11/1995 | Sucher |
| 5,487,280 | A | 1/1996 | D'Amore, Jr. |
| D378,360 | S | 3/1997 | Montaquila |
| 5,816,073 | A | 10/1998 | Bardisbanyan |
| 6,460,221 | B1 | 10/2002 | Eromaki |
| 6,843,072 | B1 | 1/2005 | Lau |
| 7,121,118 | B2 | 10/2006 | David |
| 7,347,065 | B1 | 3/2008 | DeGolyer |
| 2005/0247079 | A1 | 11/2005 | Padeh |
| 2011/0056241 | A1 | 3/2011 | Li |
| 2013/0276477 | A1 | 10/2013 | Huynh |
| 2013/0276478 | A1 | 10/2013 | Huynh |
| 2015/0075219 | A1 | 3/2015 | Huynh |

FOREIGN PATENT DOCUMENTS

| | | |
|---|---|---|
| DE | G9314157.2 | 11/1993 |
| GB | 295566 | 8/1928 |
| WO | WO 98/36656 | 8/1998 |
| WO | WO 02/32250 | 4/2002 |
| WO | WO 2013/160842 | 10/2013 |

OTHER PUBLICATIONS

International Preliminary Report on Patentability Dated Nov. 6, 2014 From the International Bureau of WIPO Re. Application No. PCT/IB2013/053232.

International Search Report and the Written Opinion Dated Sep. 26, 2013 From the International Searching Authority Re. Application No. PCT/IB2013/053232.

Notice of Allowance Dated Jun. 30, 2014 From the US Patent and Trademark Office Re. U.S. Appl. No. 13/454,231.

Official Action Dated Aug. 1, 2013 From the US Patent and Trademark Office Re. U.S. Appl. No. 13/454,231.

Official Action Dated Sep. 9, 2014 From the US Patent and Trademark Office Re. U.S. Appl. No. 13/555,154.

Official Action Dated Oct. 17, 2013 From the US Patent and Trademark Office Re. U.S. Appl. No. 13/454,231.

Official Action Dated Feb. 24, 2015 From the US Patent and Trademark Office Re. U.S. Appl. No. 13/555,154.

Official Action Dated Mar. 26, 2014 From the US Patent and Trademark Office Re. U.S. Appl. No. 13/454,231.

Official Action Dated May 28, 2014 From the US Patent and Trademark Office Re. U.S. Appl. No. 13/454,231.

Restriction Official Action Dated May 22, 2013 From the US Patent and Trademark Office Re. U.S. Appl. No. 29/427,744.

Restriction Official Action Dated Jun. 30, 2014 From the US Patent and Trademark Office Re. U.S. Appl. No. 13/555,154.

Official Action Dated Oct. 7, 2015 From the US Patent and Trademark Office Re. U.S. Appl. No. 13/555,154.

Official Action Dated Sep. 11, 2015 From the US Patent and Trademark Office Re. U.S. Appl. No. 14/396,386.

Notification of Office Action and Search Report Dated Aug. 11, 2015 From the State Intellectual Property Office of the People's Republic of China Re. Application No. 201380021816.6.

Official Action Dated Aug. 18, 2015 From the US Patent and Trademark Office Re. U.S. Appl. No. 14/396,386.

Translation Dated Aug. 30, 2015 of Notification of Office Action and Search Report Dated Aug. 11, 2015 From the State Intellectual Property Office of the People's Republic of China Re. Application No. 201380021816.6.

Supplementary European Search Report and the European Search Opinion Dated Aug. 26, 2015 From the European Patent Office Re. Application No. 13781289.7.

Written Opinion Dated Jun. 8, 2015 From the Intellectual Property Office of Singapore Re. Application No. 11201406851Q.

Official Action Dated Jun. 4, 2015 From the US Patent and Trademark Office Re. U.S. Appl. No. 13/555,154.

Restriction Official Action Dated Jun. 4, 2015 From the US Patent and Trademark Office Re. U.S. Appl. No. 14/396,386.

Patent Examination Report Dated Jan. 18, 2016 From the Australian Government, IP Australia Re. Application No. 2013254276.

Official Action Dated Feb. 1, 2016 From the US Patent and Trademark Office Re. U.S. Appl. No. 13/555,154.

Official Action Dated Jan. 25, 2016 From the US Patent and Trademark Office Re. U.S. Appl. No. 14/396,386.

Ex Parte Quayle OA Dated Jul. 15, 2016 From the US Patent and Trademark Office Re. U.S. Appl. No. 13/555,154.

Official Action Dated Aug. 3, 2016 From the US Patent and Trademark Office Re. U.S. Appl. No. 14/396,386.

Notification of Office Action and Search Report Dated Sep. 20, 2016 From the State Intellectual Property Office of the People's Republic of China Re. Application No. 201380021816.6 and Its Translation Into English.

Advisory Action Before the Filing of an Appeal Brief Dated Jul. 6, 2016 From the US Patent and Trademark Office Re. U.S. Appl. No. 14/396,386.

Notification of Office Action Dated Apr. 5, 2016 From the State Intellectual Property Office of the People's Republic of China Re. Application No. 201380021816.6.

Translation of Notification of Office Action Dated Apr. 5, 2016 From the State Intellectual Property Office of the People's Republic of China Re. Application No. 201380021816.6.

Advisory Action Before the Filing of an Appeal Brief Dated Jan. 18, 2017 From the US Patent and Trademark Office Re. U.S. Appl. No. 13/555,154. (3 pages).

Communication Pursuant to Article 94(3) EPC Dated Nov. 28, 2016 From the European Patent Office Re. Application No. 13781289.7. (6 Pages).

Official Action Dated Oct. 6, 2016 From the US Patent and Trademark Office Re. U.S. Appl. No. 13/555,154.

CLOSURE FOR ARTICLE, IN PARTICULAR FOR JEWELRY

RELATED APPLICATION/S

This application is a continuation of U.S. patent application Ser. No. 13/454,231 filed on Apr. 24, 2012. The contents of the above applications are all incorporated by reference as if fully set forth herein in their entirety.

FIELD AND BACKGROUND OF THE INVENTION

The present invention, in some embodiments thereof, relates to closures, and more particularly but not exclusively to closures for items such as jewelry, especially earrings and including huggie earrings.

Huggie earrings are a popular style of earring and are so-called because the setting hugs the earlobe. Many custom jewelers make huggie earrings because of the many varieties of setting that can be used. For example, stones may be channel set in huggie earrings. Settings for huggie earrings may come in different shapes and sizes, including hearts, rectangles, ring shapes and horseshoes.

Huggie earrings generally have closure mechanisms which provide an open position in which the pin is exposed for insertion or removal from the piercing, and a closed position for holding the earring in position once inserted.

FIG. 1A shows a basic ring-shaped huggie earring in profile and seen side on. The setting is hinged so that the earring can be opened. The earring is then inserted into the piercing and may then be closed to hold the earring securely in place. A catch holds the hinged part in position in the closed position and may be released in order to open the earring.

FIG. 1B shows a profile and perspective view of a huggie earring with five rows of gemstones in the setting, placed using an invisible setting technique.

FIG. 1C shows a profile and side-on view of another huggie earring with gemstones set in two rows using an invisible setting technique.

The closure mechanism in each case consists of a sprung catch with a release mechanism. The catch and release mechanism consists of several moving parts, each of which can be a separate cause of failure so that each moving part reduces the overall life expectancy of the product. In addition the catch and release mechanism is intrinsically awkward to use since it must be operated whilst on the ear of the wearer, a position which the wearer is unable to see so must work on touch alone.

SUMMARY OF THE INVENTION

There is provided a closure that uses shape memory to provide two stable positions. The two positions are used as an open and a closed position to secure an article such as an item of jewelry. The closure does not require any catch or release mechanism.

The earring or other piece of jewelry may be provided with such a closure. The closure may comprise a single leafspring or shaped wire looped back on itself, each part of the loop having a different remembered shape so that the closure has two stable positions which may be used as open and closed positions of the earring. The single working part reduces possible sources of failure, and the two stable positions may be easier to achieve by feel alone compared with operating a spring loaded catch. The leafspring ends may be pivoted or otherwise attached to the setting at two locations.

According to an aspect of some embodiments of the present invention there is provided a jewelry item, the jewelry item having two ends and a closure spanning a space between the two ends, the closure comprising a leaf spring extending outwardly in a first loop part from a first location on the first end and looping back in a second loop part to a second location adjacent the first location on the first end, the loop parts each having respectively different remembered shapes, the different remembered shapes configuring the closure to flip between two stable positions, a first position in which the closure connects to the second end to close the earring and a second position in which the closure is spaced away from the second end to open the jewelry item.

In an embodiment, the jewelry item comprises an earring, the earring comprising a setting and a pin, and the closure for closing over the pin, the first end being on the setting and the second end being a free end of the pin, the first position being a position in which the closure connects to the pin to close the earring and the second position being a position in which the closure is spaced away from the pin to open the earring.

In an embodiment, the closure is pivoted to the setting at the first and second locations respectively.

In an embodiment, the closure is soldered to the setting at the first and second locations respectively.

In an embodiment, the closure comprises a bar at the upper end from which the first and second loop parts extend perpendicularly.

In an embodiment, the closure comprises a stem at the upper end from which the first and second loop parts extend longitudinally.

In an embodiment, the pin comprises an inclusion to capture the closure in the closed position.

The item may be a huggie style caning.

According to a second aspect of the present invention there is provided a closure for a jewelry item, the jewelry item having two ends and the closure spanning a space between the two ends, the closure comprising a leaf spring extending outwardly in a first loop part from a first location on the first end and looping back in a second loop part to a second location adjacent the first location on the first end, the loop parts each having respectively different remembered shapes, the different remembered shapes configuring the closure to flip between two stable positions, a first position in which the closure connects to the second end to close the earring and a second position in which the closure is spaced away from the second end to open the jewelry item.

According to a third aspect of the present invention there is provided a method of manufacturing a closure for a jewelry item, comprising: constructing a closure by looping a leaf spring, so that the leaf spring extends outwardly in a first loop part from a first end and loops back in a second loop part to a second end, imparting to each of the loop parts respectively different remembered shapes, the different remembered shapes configuring the closure to flip between two stable positions, fitting the first and second ends of the closure at one end of a jewelry item, and configuring the closure with the jewelry item so that one of the stable states defines a first position in which the closure connects to a second end of the jewelry item to close the jewelry item, and the second of the stable states defines a second position in which the closure is spaced away from the second end of the jewelry item to open the jewelry item.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. The data processor may include a volatile memory for storing instructions and/or data and/or a non-volatile storage, for example, a magnetic hard-disk, flash memory and/or removable media, for storing instructions and/or data. A network connection may be provided and a display and/or a user input device such as a keyboard or mouse may be available as necessary.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

The present invention, in some embodiments thereof, relates to closures for articles such as items of jewelry, and more particularly but not exclusively to jewelry, for example earrings, such as huggie earrings.

Such an earring may have a setting and a pin, and a closure for closing over the pin. The closure consists of a leaf spring extending outwardly in a first loop part from a first location on the setting and looping back in a second loop part to a second location adjacent the first location on the setting. The loop parts each have shape memory and are set with different remembered shapes. The two different remembered shapes work against each other to flip the closure between two stable positions, a first position in which the closure connects to the pin to close the earring and a second position in which the closure is spaced away from the pin to open the earring. The design is particularly suitable for a huggie style earring.

The present embodiments may thus provide a one part locking mechanism piece made of such a looped over leaf spring. The leaf spring may have two pivoted hinges or soldered joints fixed to the setting and may always flip between one of two stable positions caused by two remembered shapes of each half of the loop working against each other. The mechanism consists of a single part and thus does not have the problems of known earrings because there is no spring or catch or other separate parts, thus reducing the overall failure rate.

The looped over leaf spring thus provides a catch mechanism based on the two stable states, an open state allowing attachment and detachment of the earring from the earlobe and a closed state, locking the earring in position on the earlobe. The mechanism is applicable not just to huggie style earrings but to any kind of earring or any other piercing or any kind of jewelry which requires an easy to operate mechanism for locking in position.

The looped over leaf spring may be made of two different metals fused together to enhance the shape memory.

Figure 1B:
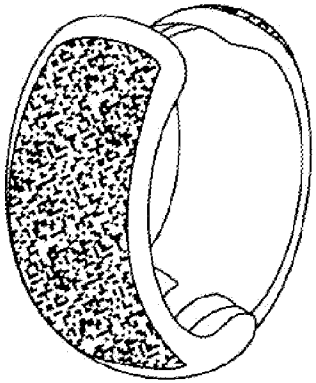
FIGS. 1A-1C are examples of prior art huggie earrings.
Figure 1A:
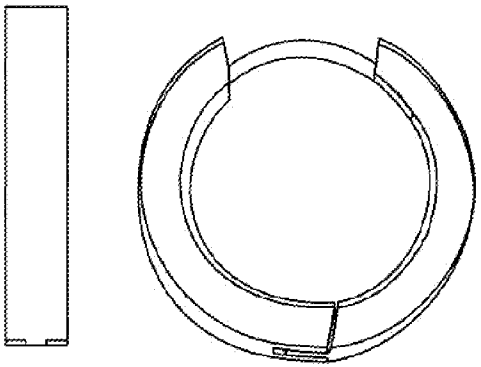
Figure 1C:
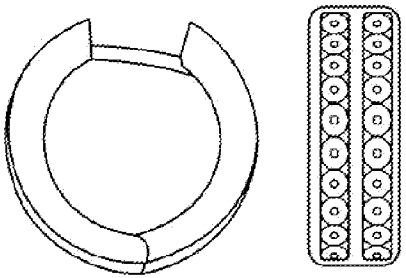
FIG. 1C Prior Art

FIGS. 1A-1C are discussed in the background and show examples of three huggie earrings of the known art. Each of the earrings shown has a closing mechanism that comprises a hinge with a spring or other type of locking mechanism, the additional parts increasing the failure rate.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Figure 2:
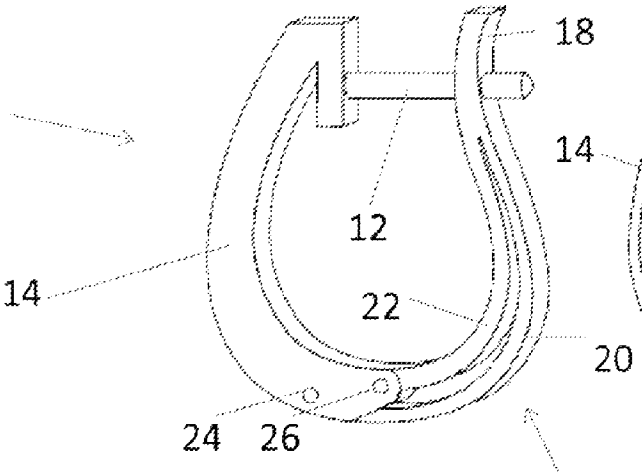
FIG. 2 is a perspective view of a huggie earring according to a horseshoe embodiment of the present invention with the closure in a closed position.
Figure 3:
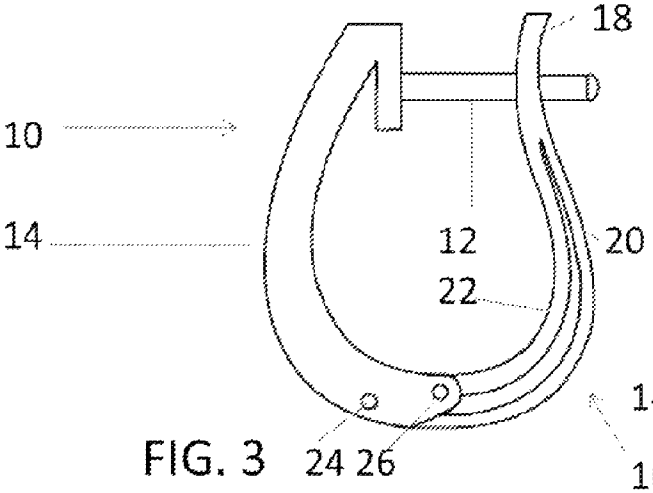
FIG. 3 is a two-dimensional view of the earring of FIG. 2.

Referring now to the drawings, FIG. 2 is a simplified diagram showing a schematic three-dimensional perspective view of a huggie earring according to a first embodiment of the present invention. FIG. 3 is a two dimensional profile of the same embodiment. In FIG. 2, a huggie earring 10 comprises a pin 12 for fitting through the piercing, a front setting part 14 and a closure part 16. The closure part 16 comprises a leaf spring element 18 that forks into upper 20 and lower 22 leaf spring continuations or prongs. From another point of view the leaf spring starts at one prong, extends to base element 18 and loops back as the other prong. Each of the leaf spring continuations is attached separately by a respective hinge 24 and 26, to the setting 14. The hinges or pivots allow each leaf spring continuation to rotate independently, and thus give rise to two stable positions as will be detailed below and include a mechanism for flipping or jumping between them.

The balance of forces between the two leaf spring continuations mandates two stable positions, one as shown in FIGS. 2 and 3 in which the caning is closed and a second position where the caning is open and the pin is free to be inserted and removed from the ear piercing. This contrasts with the prior art systems of FIG. 1 where a single hinge is spring loaded to flip between open and closed positions.

Figure 4:
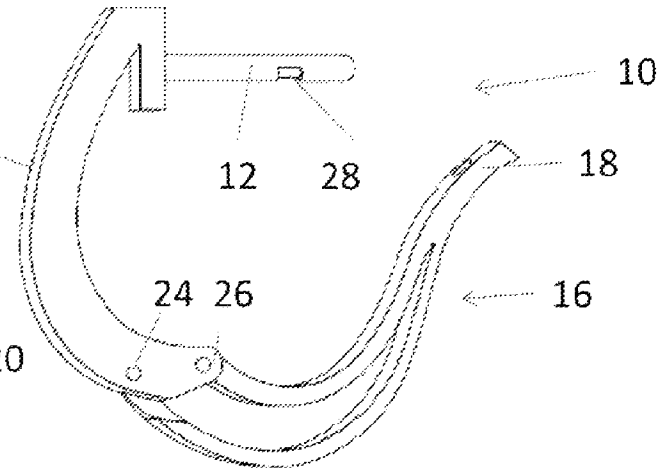
FIG. 4 is a perspective view of the huggie earring of FIG. 2 with the closure in an open position.
Figure 5:
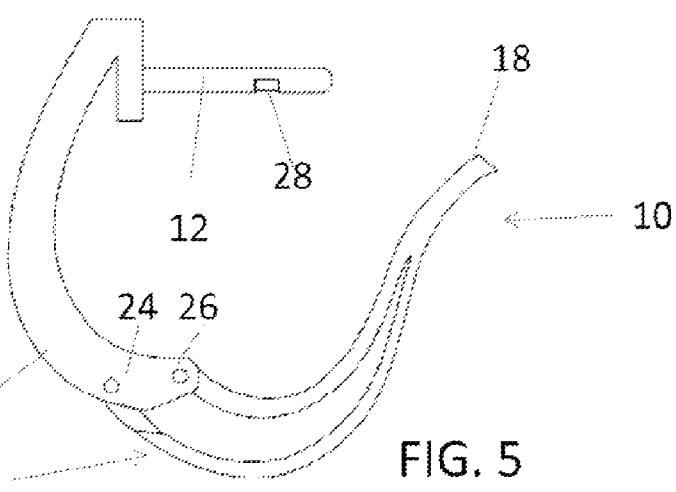
FIG. 5 is a two-dimensional view of the earring of FIG. 4.

Reference is now made to FIGS. 4 and 5, which are 3D perspective and 2D face on views of the huggie earring of FIG. 2 in the open position. Parts that are the same as in preceding figures are provided with the same reference numerals and are not described again except as needed for understanding the present figure.

In FIG. 4 the closure part 16 has been opened by rotating closure end 18, causing leaf spring continuations 20 and 22 to rotate on pivots 24 and 26 and reach a second stable position. An inclusion 28 on the pin catches the lower end of the closure when in the first stable position, that is the closed position.

Figures 6, 7, 8:
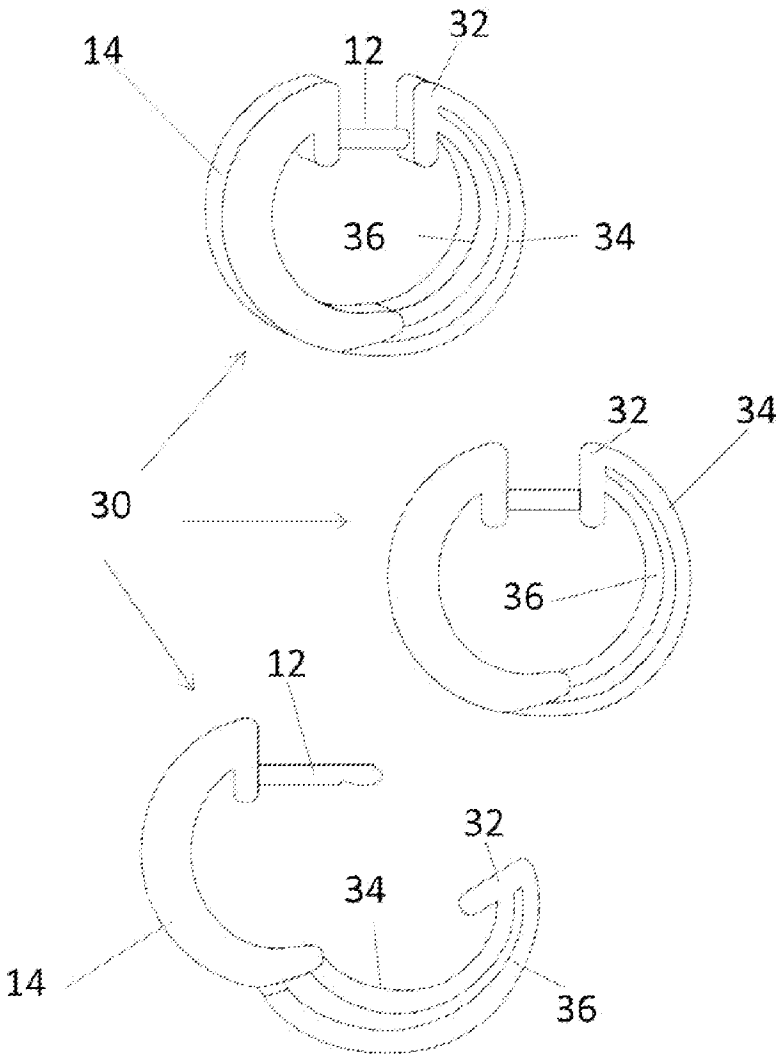
FIG. 6 is a perspective view of a huggie earring according to a round embodiment of the present invention.
FIG. 7 is a two-dimensional view of the huggie earring of FIG. 6.
FIG. 8 is a two-dimensional view of the huggie caning of FIG. 6 in an open position.

FIGS. 6-8 illustrate a rounded version 30 of a huggie caning according to the present embodiments. FIG. 6 is a simplified 3 dimensional perspective view of the rounded earring 30. FIG. 7 is a two dimensional view showing a cross-section of the caning, and FIG. 8 is a two dimensional view showing the earring in the open position. In rounded caning 30 the top 32 of the closure 16 is a bar. Leaf springs 34 and 36 extend at right angles from two different locations at different heights of the bar 32 and curve downwards. At the far end the leafsprings are soldered or welded onto respective locations on the setting 14. From another point of view a single continuous leaf spring begins at one of the welds, loops up via bar 32 and then continues down the leaf spring extension to the second weld. The springiness of the two leafsprings 34 and 36 allows them to alternate between two stable positions as in the previous embodiments. Pivots however could be used as an alternative, and for that matter, soldering could be used on the horseshoe shaped earring 10.

Figure 9:
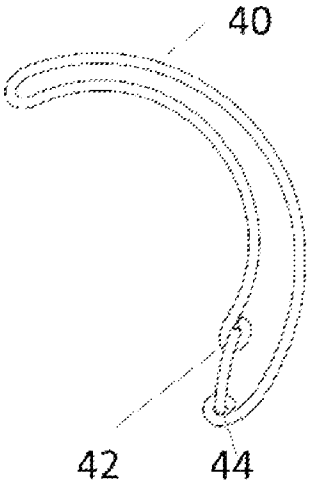
FIG. 9 is a schematic drawing showing a looped leaf-spring in a first stable position.
Figure 10:
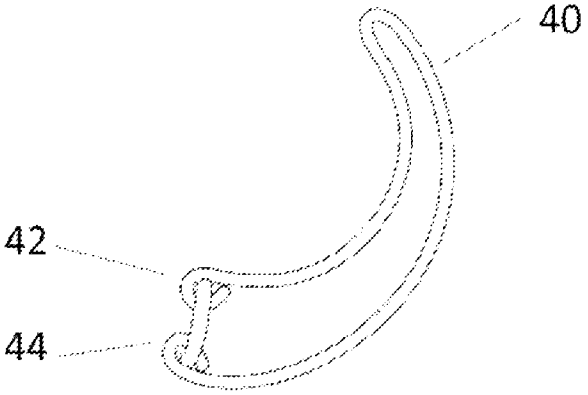
FIG. 10 is a schematic drawings showing a looped leaf-spring in a second stable position.

Reference is now made to FIGS. 9 and 10 which illustrate the principle of the two stable positions. A single continuous length of leafspring 40 is curved back on itself and moves under the constraint that the two ends 42 and 44 of the leafspring are fixed. The two sides of the leafspring push against each other as they attempt to move within the constraints. The leafsprings typically have a shape memory so that two equilibrium positions can be defined, such as those shown in FIG. 9 and FIG. 10. That is to say a different shape may be provided to each side of the looped leafspring and then the closure is flipped between a first stable position where a first side is dominant and a second stable position where the second side is dominant.

The position in FIG. 9 may be used to provide the closed position of the huggie caning and that of FIG. 10 may provide the open position of the caning.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that all features of the invention, which are, for clarity, described in the context of separate embodiments, may also be provided in combination in a single embodiment, and this document is to be understood as if such features are explicitly included. Conversely, various features of the invention, which are, for brevity, described in the context of a single embodiment, may also be provided separately or in any suitable subcombination or as suitable in any other described embodiment of the invention, and this document is to be understood as though such inclusions are explicitly made. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A jewelry item, comprising a setting having first and second ends and a pin having a first end attached to the second end of the setting and extending therefrom, and a closure spanning a space between said two ends, the closure comprising a first bent leaf shaped springy element and a second bent leaf shaped springy element, a first end of each of the elements being attached together, where the first and second bent leaf shaped springy elements extend toward adjacent respective locations on the first end of the setting, each of said first and second bent leaf shaped springy elements having shape memory and being shaped with a respectively different shape that is remembered, and attachment and shaping of the leaf shaped springy elements being such that the respectively different remembered shapes work against each other to enable the closure to flip between a first and a second stable configuration, the first position being a position in which the closure is adjacent to the second end to close the earring and the second position being a position in which the closure is spaced away from the second end to open the jewelry item.

2. The jewelry item of claim 1, wherein the closure in said first configuration closes over a second end of the pin, and where in the second configuration being a configuration in which the first end of the elements are spaced away from the pin to open the earring.

3. The jewelry item of claim 2, wherein said first and second leaf shaped springy elements are pivotally attached to said setting at said first and second locations respectively.

4. The jewelry item of claim 2, wherein said pin comprises an inclusion to capture said closure in said closed position.

5. A jewelry item according to claim 3 wherein the first and second locations are at different distances from the second end of the item.

6. A jewelry item according to claim 1 wherein springy leaf elements are of different lengths.

7. A jewelry item according to claim 1 wherein the two spring leaf elements are spaced apart in a direction in which the springy leaf shaped elements travel from the first to second stable configurations.

8. A jewelry item according to claim 1 wherein the first and second configurations are stable configurations and wherein the leaf shaped springy elements rotate approximately 90 degrees between the two stable configurations.

9. A jewelry item, having first and second ends and a closure spanning a space between said two ends, the closure comprising a first bent leaf shaped springy element having a shape memory and a first shape, and a second bent leaf shaped springy element having a shape memory and a first shape, a first end of each of the elements being attached together, where both the first and second bent springy leaf shaped elements are pivotally attached at a second end thereof to respective adjacent locations on a first end of the jewelry item, the adjacent locations being located at different distances from the second end of the jewelry item, wherein the springy leaf shaped elements are of different lengths, said different lengths and said respective first and second shapes working against each other to provide first and second stable positions of said closure.

10. The jewelry item of claim 9, wherein the jewelry item comprises a setting and a pin, the pin having a first end attached to the second end of the setting and extending therefrom, where the closure in a first stable configuration closes over a second end of the pin, and where in a second stable configuration the first ends are spaced away from the setting to open the earring.

11. A jewelry item according to claim 10 wherein in the first configuration the closure does not touch the second end of the setting even in the absence of an ear of the user.

* * * * *